US011339801B2

(12) United States Patent
Ehlers et al.

(10) Patent No.: US 11,339,801 B2
(45) Date of Patent: May 24, 2022

(54) CENTRIFUGAL BLOWER HAVING AN INTEGRATED COOLING FUNCTION

(71) Applicant: ebm-papst St. Georgen GmbH & Co. KG, St. Georgen (DE)

(72) Inventors: Volker Ehlers, St. Georgen (DE); Andreas Kuhlmey, Schramberg (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 0 days.

(21) Appl. No.: 17/286,399

(22) PCT Filed: Oct. 30, 2019

(86) PCT No.: PCT/EP2019/079619
§ 371 (c)(1),
(2) Date: Apr. 16, 2021

(87) PCT Pub. No.: WO2020/104153
PCT Pub. Date: May 28, 2020

(65) Prior Publication Data

US 2021/0388850 A1 Dec. 16, 2021

(30) Foreign Application Priority Data

Nov. 23, 2018 (DE) ..... 10 2018 129 613.4

(51) Int. Cl.
*F04D 29/58* (2006.01)
*F04D 17/16* (2006.01)
(Continued)

(52) U.S. Cl.
CPC ..... *F04D 29/584* (2013.01); *F04D 17/16* (2013.01); *F04D 29/056* (2013.01); *F04D 29/441* (2013.01)

(58) Field of Classification Search
CPC ..... F04D 29/584; F04D 17/16; F04D 29/056; F04D 29/441; F04D 25/0606
See application file for complete search history.

(56) References Cited

U.S. PATENT DOCUMENTS 5,954,488 A 9/1999 Graham et al.
7,942,646 B2 * 5/2011 Zhou ..... F04D 29/584 417/366

(Continued)

FOREIGN PATENT DOCUMENTS

EP 2000675 A2 12/2008
WO 2016169610 A1 10/2016

OTHER PUBLICATIONS

International Search Report in German, dated Jan. 23, 2020, issued in the corresponding PCT Patent Application No. PCT/EP2019/079619, including English Translation.

*Primary Examiner* — Courtney D Heinle
*Assistant Examiner* — Andrew Thanh Bui
(74) *Attorney, Agent, or Firm* — Dickinson Wright PLLC

(57) ABSTRACT

A radial fan (1) or centrifugal blower is provided having a fan housing (2) with a spiral pressure chamber (D) and a rotor assembly (10) comprising an internally axially open bearing tube (20), in which a shaft (40) carrying a fan wheel (30) is mounted with a rotor (50) of a canned motor. An air-guiding channel (L) between a first pressure-chamber region (2*a*) and a second pressure-chamber region (2*b*) of the spiral pressure chamber (D) is formed between the bearing tube (20) and the wall (W) of the canned motor, so that an air flow flows through the air-guiding channel (L) from one pressure-chamber region (2*a*, 2*b*) to the other and in the process dissipates heat from the bearing tube (20) into the pressure chamber (D).

12 Claims, 5 Drawing Sheets

(51) Int. Cl.
*F04D 29/056* (2006.01)
*F04D 29/44* (2006.01)

(56) References Cited

U.S. PATENT DOCUMENTS 8,215,928 B2 * 7/2012 Agrawal ..... F04D 29/057
417/373
2018/0274545 A1 9/2018 Ragg

* cited by examiner

CENTRIFUGAL BLOWER HAVING AN INTEGRATED COOLING FUNCTION

FIELD

The disclosure relates to a radial fan which has an integrated cooling function.

BACKGROUND

In radial fans exists the problem that heat is generated due to mechanical friction in the bearing of the rotor shaft and leads to overheating. This problem exists particularly in radial fans for high rotational speed applications in which the fans are intended to be mounted in a single-piece separating can which is axially closed on one side, since there heat is additionally prevented by the separating can from being transported outward.

High rotational speed applications in the sense of the present disclosure are rotational speeds of the fan wheel in which the circumferential speed on the radial compressor outlet is at least 60 m/s. Thereby, the thermal problem is worsened, since additional heat is necessarily also generated with increasing rotational speed.

In some application cases, the housings of high rotational speed fans are produced from a metal. Thereby, cooling is ensured, and the heat can escape easily via the thermally conducting housing wall. Alternatively, in larger or stationary high rotational speed fans, more expensive oil and water cooling can be used. To the extent that a medium can be used for cooling, this medium flows around the region to be cooled.

For the case in which the housing is formed completely from metal, the disadvantage consists in that only limited forming and connection techniques can be used. Producing the primary housing of the fan from plastic in fact allows greater freedom of design and enables alternative joining methods, but the heat transport is then unsatisfactory.

In the case of cooling of bearings by auxiliary media such as oil or water, this requires high construction expenditures as well as additional units.

SUMMARY

The underlying aim of embodiments of the disclosure therefore is to overcome the above-mentioned disadvantages and to provide a rotor assembly of a radial fan, in particular of a high rotational speed radial fan, which offers an optimized cooling possibility for cooling of bearings.

This aim is achieved by the combination of features according to claim 1.

According to the disclosure, proposed for this purpose is a high rotational speed radial fan with a fan housing with a spiral pressure chamber (spiral channel) comprising an internally axially open bearing tube in which a shaft carrying a fan wheel is mounted with a rotor of a canned motor, wherein an air-guiding channel between a first pressure-chamber region and a second pressure-chamber region of the spiral pressure chamber is formed between the bearing tube and the wall of the separating can of the canned motor, so that an air flow flows through the air-guiding channel from one pressure-chamber region to the other (in particular through a region in the separating can) and in the process dissipates heat from the bearing tube into the pressure chamber.

In an advantageous embodiment of the disclosure, it is provided that at least one air channel opening of the air-guiding channel opens directly into the pressure chamber. The design of the opening can be chosen here so that the opening is oriented in a manner which promotes flow and inflow of the air in the spiral pressure chamber is promoted.

Additionally, it is advantageously provided that at least one air channel opening is arranged in a region in a pressure chamber of the housing in which the pressure during the operation of the fan is higher with respect to an air channel outlet of the air-guiding channel.

Another advantageous embodiment is one in which a projection is formed by the bearing tube and said projection is designed as a substantially round plate-like projection, the diameter of which is greater than the diameter of the fan wheel.

The bearing tube with collar is installed in the housing, so that a mutually nested construction is formed. In the gap between the bearing tube with collar and the housing, the air guide channel can be formed at least partially by material recesses in the form of channels or grooves. These channels are designed so that at least one channel has an opening to the spiral channel of the impeller. The opening(s) in the spiral channel is/are here preferably placed so that they have the highest possible pressure difference in the common work points of the fan. The respective other opening of the channels is located in the region of the outer diameter of the bearing tube. Thus, during the operation of the radial fan, a continuous flow of medium is generated, which flows into the channel on the "high-pressure side" of the spiral channel, flows around the bearing tube in the center, and finally again flows through the other channel(s) on the "low-pressure side" of the spiral channel into the spiral channel. Here, heating of the medium occurs, and the amount of heat of the rotor system is thereby dissipated in a targeted manner. The positioning of the bleed air openings here does not necessarily have to occur in diametrically opposite positions. A variation with multiple channels for targeted flow design is as advantageous as only a single channel with central backflow beneath the impeller. Furthermore, not all the bleed air openings have to extend into the spiral channel. Depending on pressure ratios in the flow region, it can be advantageous that, for example, one of the channels ends on the surface beneath the impeller.

In a particularly advantageous embodiment of the disclosure, it is provided that multiple air-guiding channels form a common air channel system and they are connected to one another so that an air flow flows through the air channel system from one pressure-chamber region to the other and in the process dissipates heat from the bearing tube into the pressure chamber via the multiple air-guiding channels.

Another advantageous embodiment of the disclosure provides that the air-guiding channel(s) is/are formed in the fan housing as groove-like recesses.

Furthermore, it is advantageous if the air-guiding channels are formed in a region beneath the projection and are delimited by the projection. In this manner, the channel is delimited on one side by the projection of the bearing tube.

Furthermore, it can be provided that the air-guiding channel extends directly through a housing bottom plate formed by the fan housing, plate which is located flat beneath the fan wheel.

In an embodiment of the disclosure (preferably when only one channel is provided), the opening to the air-guiding channel in the first pressure chamber region and the opening to the air-guiding channel in the second pressure chamber region of the spiral pressure chamber are provided in diametrically opposite positions. However, multiple channels distributed in a star pattern and intersecting in the center can also be provided, the openings of which are in each case diametrically opposite.

It is advantageous if the shaft is mounted on a first bearing arranged in the bearing tube and on a second bearing arranged spaced axially therefrom in the bearing tube in a region between the fan wheel and the rotor, and the air-guiding channel extends so that an air flow in the separating can (also) flows around the region of the bearings.

A constructively advantageous solution moreover provides that the separating can is designed to form a single piece with the fan housing.

BRIEF DESCRIPTION OF THE DRAWINGS

Additional advantageous developments of the disclosure are characterized in the dependent claims and represented in further detail below together with the description of the preferred embodiment of the disclosure in reference to the figures.

DETAILED DESCRIPTION OF EXAMPLE EMBODIMENTS

Below, example embodiments are described in further detail in reference to FIGS. 1 to 9, wherein identical references denote identical structural and/or functional features.

Figure 1:
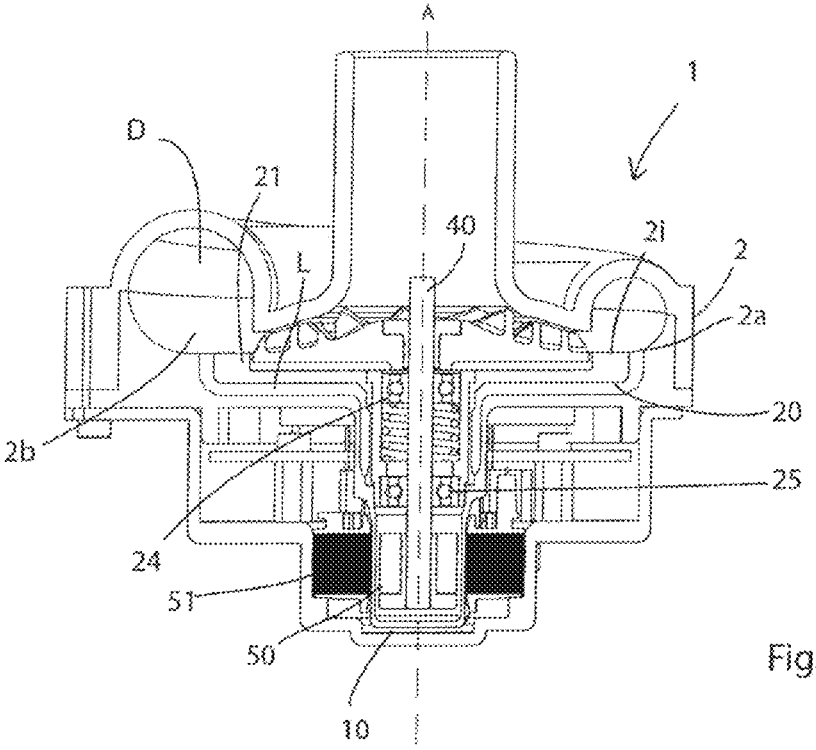
FIG. 1 is a lateral cross-sectional view of an embodiment example of a radial fan.

In FIG. 1, an embodiment example of a radial fan 1 is shown.

The radial fan 1 comprises a rotor assembly 10. Said rotor assembly is designed for a high rotational speed radial fan. The rotor assembly 10 comprises an internally axially open bearing tube 20. In the bearing tube 20, a shaft 40 is mounted, wherein, on the shaft 40, a rotor 50 of a canned motor is mounted. The external stator 51 of the motor can also be seen in FIGS. 1 and 2. The bearing tube 20 comprises an outward protruding radial projection 21. This projection 21 extends over the outer circumference 31 of the fan wheel 30.

Figure 2:
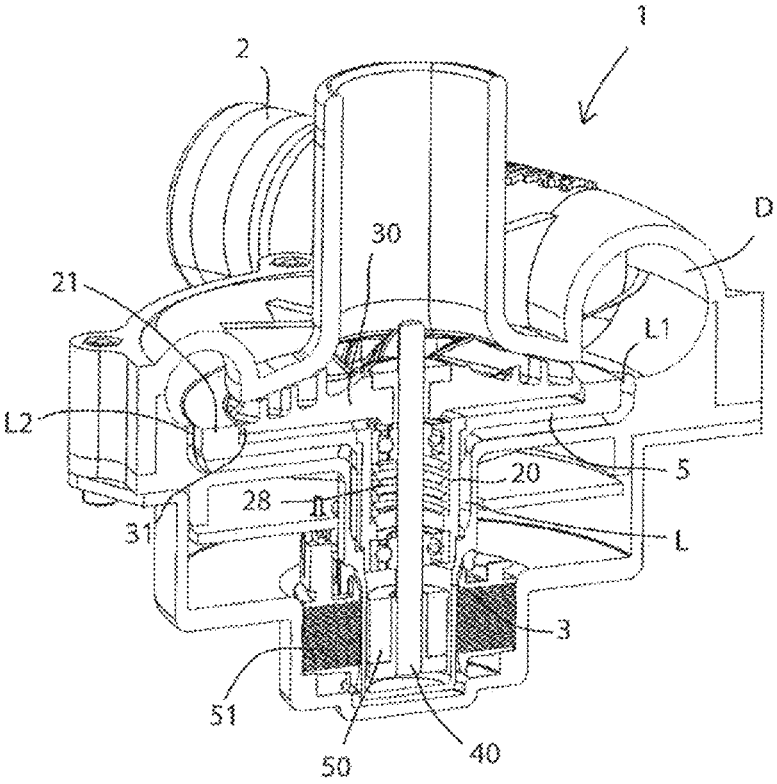
FIG. 2 is a perspective cross-sectional view through the radial fan according to FIG. 1.
Figure 3:
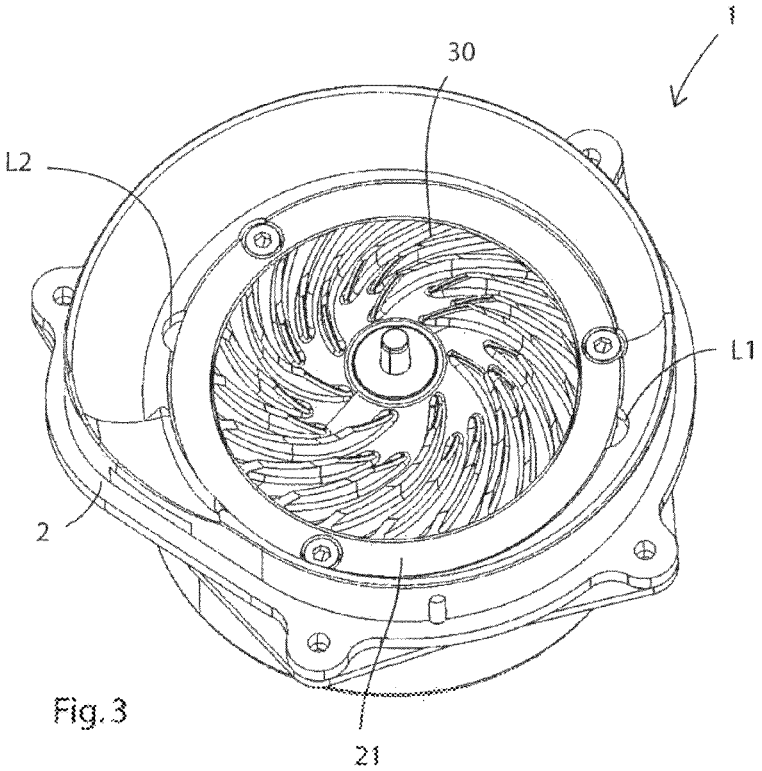
FIG. 3 is a perspective view onto the embodiment example according to FIG. 2 with open fan housing.
Figure 4:
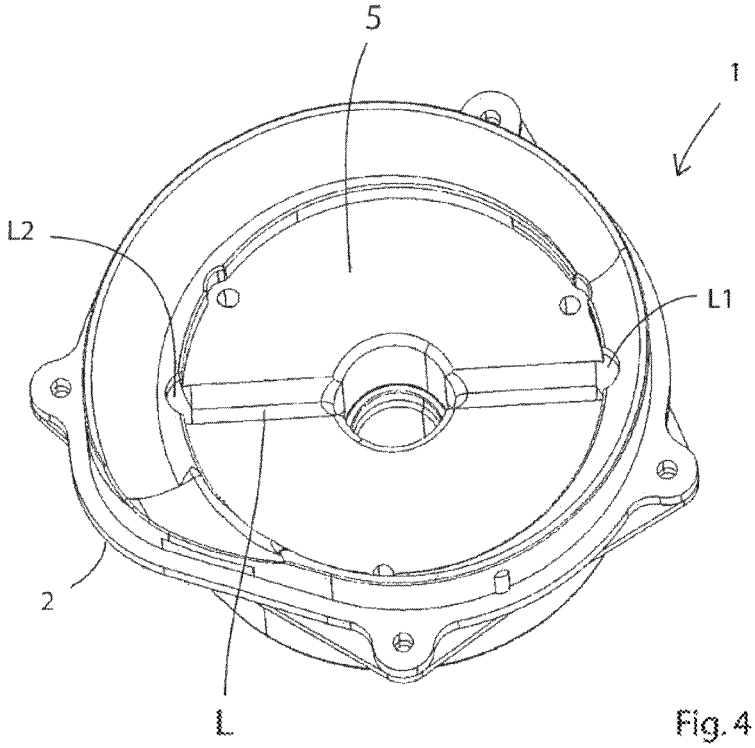
FIG. 4 is a perspective view onto the embodiment example according to FIG. 3, but without the fan wheel and without the rotor assembly with collar.
Figure 5:
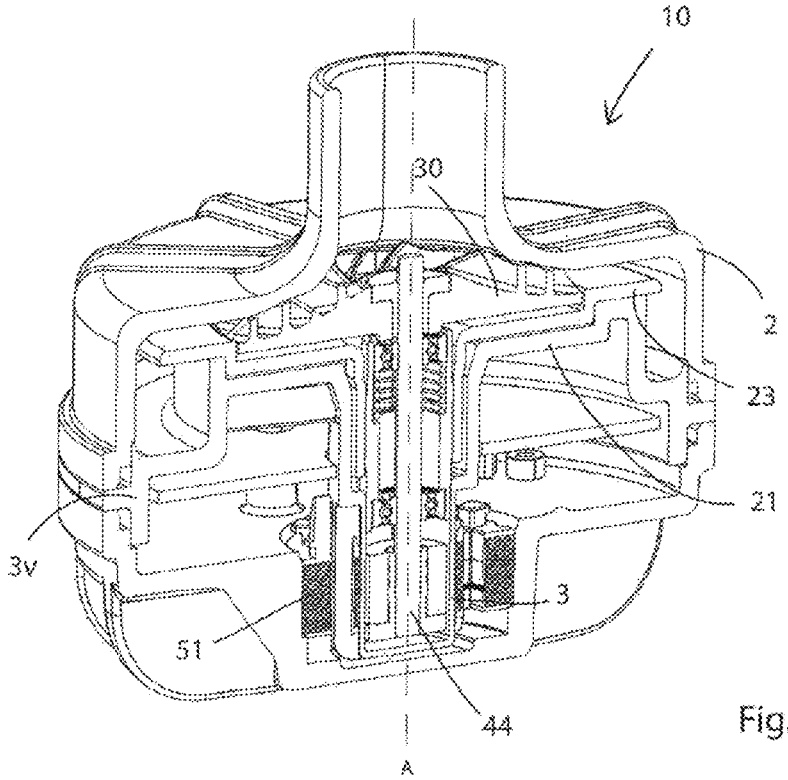
FIGS. 5, 6, 7, 8 and 9 are additional example embodiments.
Figure 6:
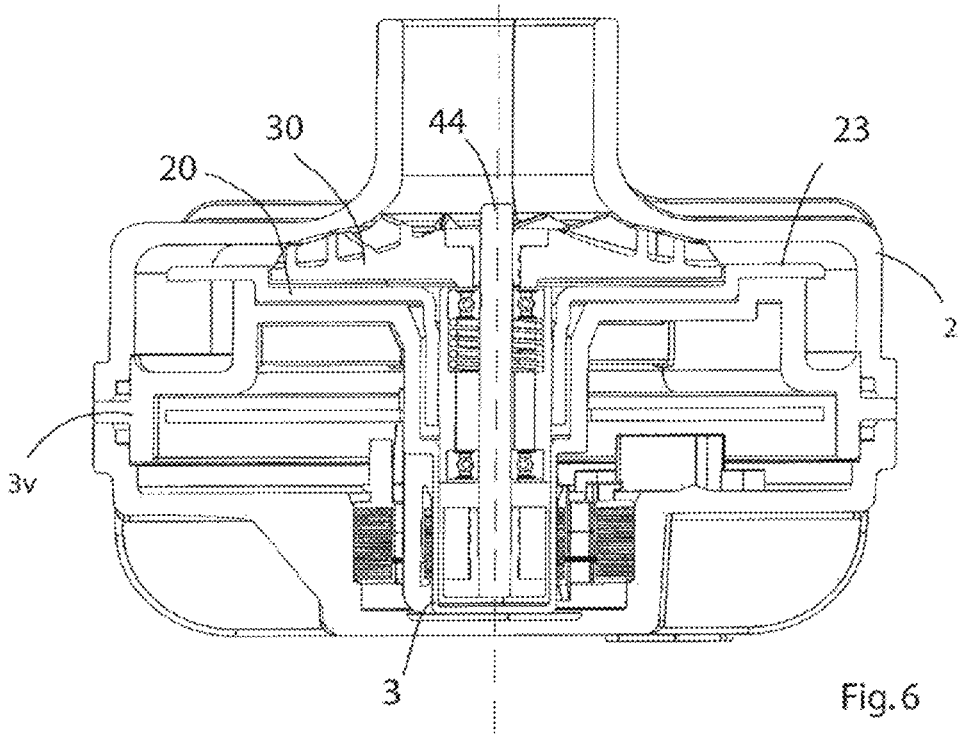
Figure 7:
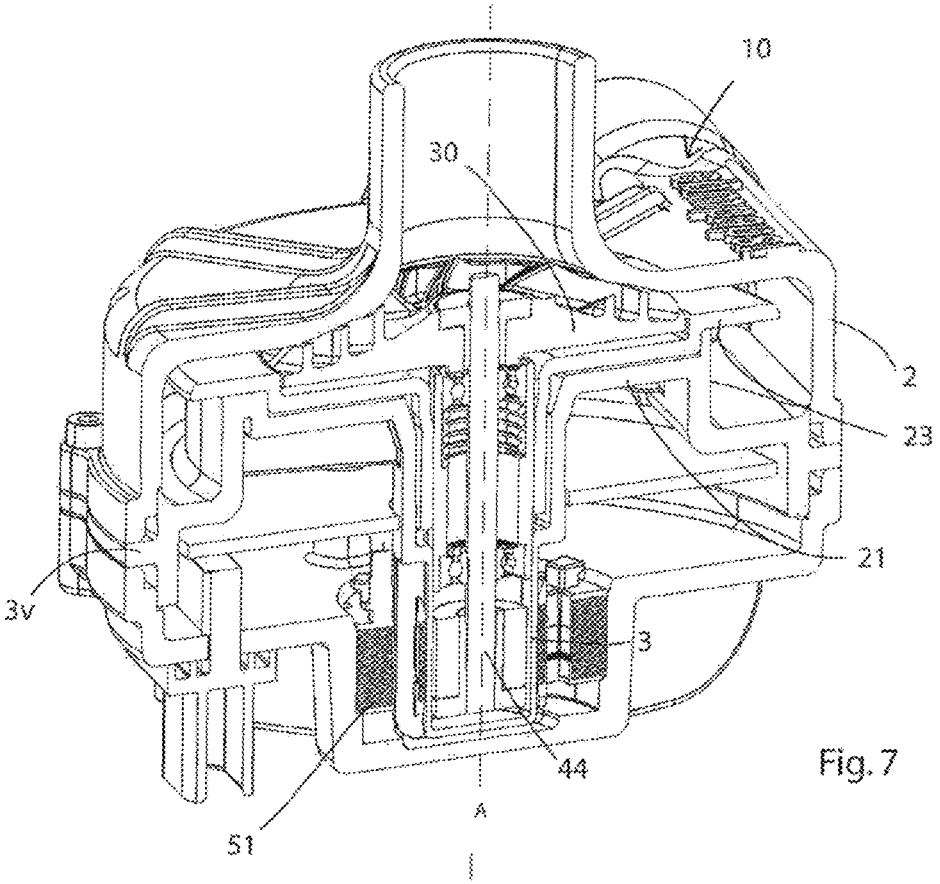
Figure 8:
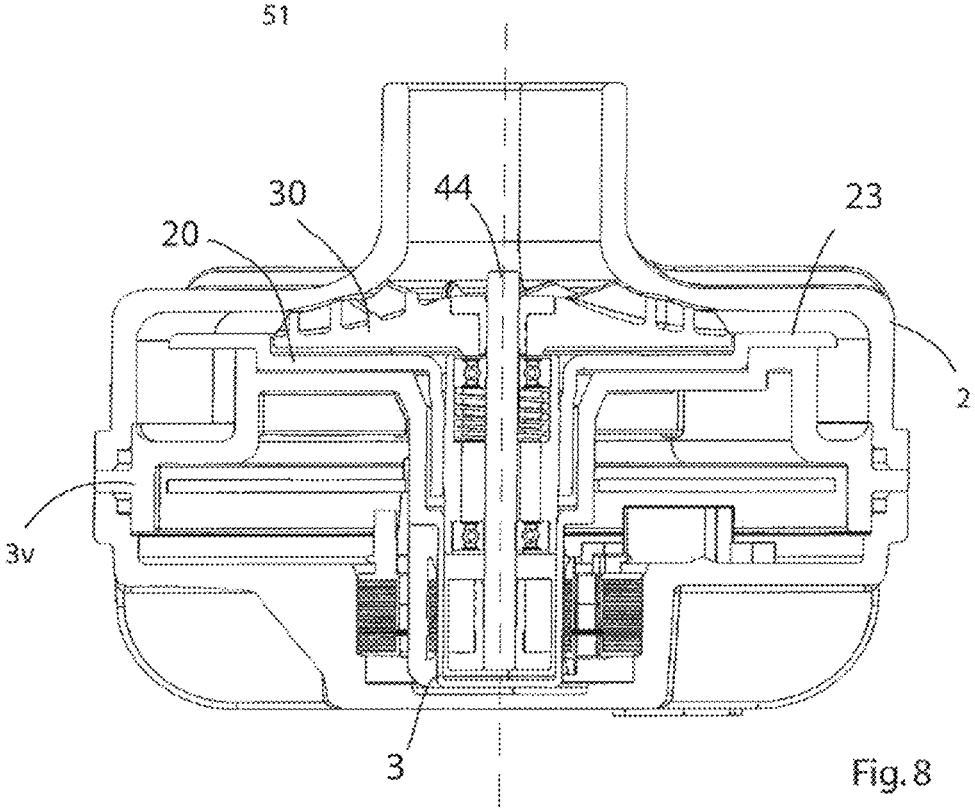

In the cross-sectional view according to FIG. 1, as well as in the perspective cross-sectional view of FIG. 2, it can easily be seen that the projection 21 extends over the outer circumference 31 of the fan wheel 30. The projection 21 is designed substantially as a round plate-like projection, the diameter of which is greater than the diameter of the fan wheel 30. The fan wheel 30 is placed on the shaft 40 so that the fan wheel 30 is arranged in the recess in the projection 21.

The radial fan 1 has a fan housing 2 with a spiral pressure chamber D. The rotor 50 which is positioned on the shaft 40 is mounted as a canned motor in the separating can 3, wherein an air-guiding channel L between a first pressure chamber region 2*a* and a second pressure chamber region 2*b* of the spiral pressure chamber D is formed between the bearing tube 20 and the wall of the separating can 3 of the canned motor, so that an air flow flows through the air-guiding channel L from one pressure chamber region 2*a*, 2*b* to the other and in the process dissipates heat from the bearing tube 20 into the pressure chamber D.

The shaft 40 is mounted between the two bearings 24, 25, wherein a spring 28 is preloaded and braces against the first bearing 24. The second bearing (in FIG. 1 lower bearing 25) sits on the lower end of the bearing tube 20. Through the lower bearing 25, the shaft 40 with the rotor 50 extends.

The bearing tube 20 rests by means of its radial projection 21 on the housing bottom plate 5 and is attached to the fan housing 2 by means of a screw connection. In the embodiment represented here, the air channel openings L1, L2 of the air-guiding channel L open directly into the pressure chamber D, as can easily be seen in FIG. 4. Furthermore, in FIG. 4, it can be seen that the two partial air-guiding channels in each case are designed in the fan housing 2 as groove-like recesses and extend in each case from the pressure chamber D to the separating can 3.

Figure 9:
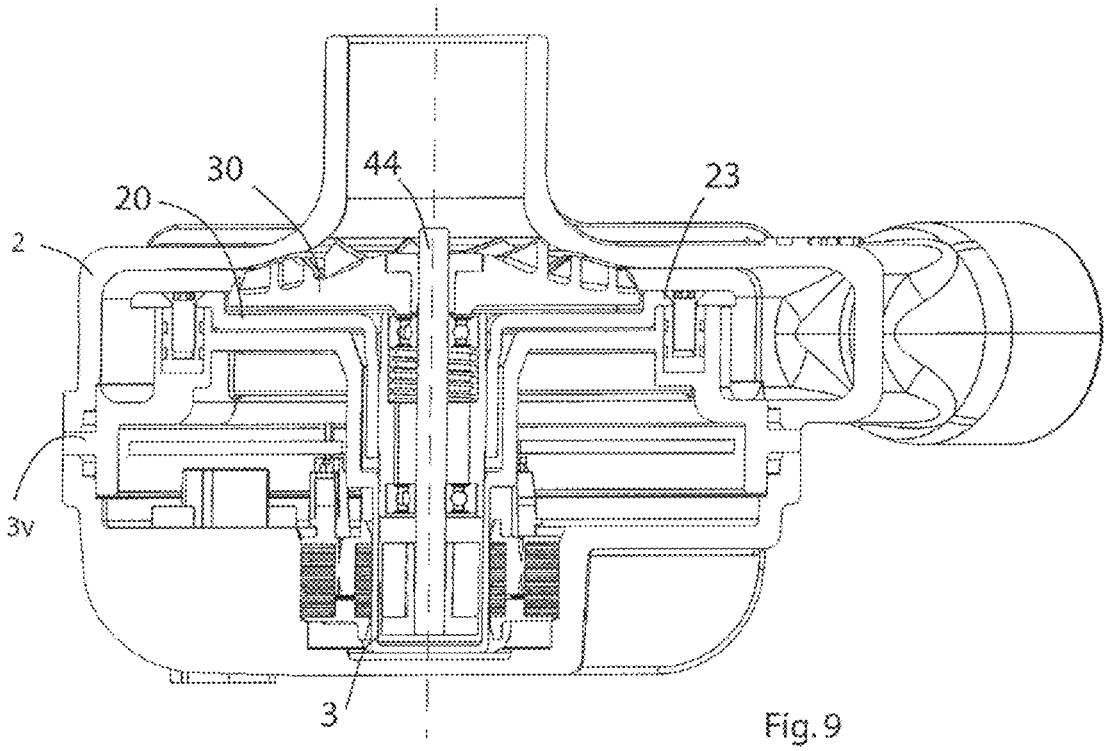

In FIGS. 5 to 9, additional embodiments of the disclosure are found, wherein, in particular, the design of the housing 2, of the separating can 3, of the bearing tube 20, and the design of the heat dissipation section 23 has occurred in an alternative form. The projection of the separating can 3*v*, which extends between a housing upper portion and a housing lower portion of the housing 2, can also be seen. In FIG. 9, it can moreover be seen that, in the region of the heat dissipation section 23, an attachment opening is provided, in order to attach the projection of the bearing tube 20 to the projection of the separating can 3.

The embodiments of the disclosure are not limited to the above-mentioned preferred embodiment examples. Instead, a number of variants are conceivable, which use the represented solution, even in embodiments of fundamentally different type. Thus, the represented air-guiding channel, for example, can also be formed by a plurality of channels.

The invention claimed is:

1. A radial fan (1) with a fan housing (2) with a spiral pressure chamber (D) and a rotor assembly (10) comprising an internally axially open bearing tube (20), in which a shaft (40) carrying a fan wheel (30) is mounted with a rotor (50) of a canned motor, wherein an air-guiding channel (L) between a first pressure-chamber region (2*a*) and a second pressure-chamber region (2*b*) of the spiral pressure chamber (D) is formed between the bearing tube (20) and a wall (W) of a separating can (3) of the canned motor, so that an air flow flows through the air-guiding channel (L) from one pressure-chamber region (2*a*, 2*b*) to the other and in the process dissipates heat from the bearing tube (20) into the pressure chamber (D).

2. The radial fan (1) according to claim 1, characterized in that at least one air channel opening (L1) opens directly into the pressure chamber (D).

3. The radial fan (1) according to claim 2, characterized in that at least the air channel opening (L1) is arranged in a region in the pressure chamber (D) in which the pressure during the operation of the fan is higher with respect to an air channel outlet (L2) of the air channel (L).

4. The radial fan (1) according to claim 1, characterized in that a projection (21) is formed by the bearing tube (20) and is configured as a round projection, the diameter $D_A$ of which is greater than the diameter $D_V$ of the fan wheel.

5. The radial fan (1) according to claim 1, characterized in that multiple air-guiding channels (L) form a common air channel system and they are connected to one another so that an air flow flows through the air channel system from one pressure-chamber region to the other (2*a*, 2*b*) and in the process dissipates heat from the bearing tube (20) into the pressure chamber (D) via the multiple air-guiding channels (L).

6. The radial fan (1) according to claim 5, characterized in that the air-guiding channel(s) (L) is/are formed in the fan housing (2).

7. The radial fan (1) according to claim 5, wherein a projection (21) is formed by the bearing tube (20) and is configured as a round projection, the diameter $D_A$ of which is greater than the diameter $D_V$ of the fan wheel and further characterized in that the air-guiding channels (L) are formed in a region beneath the projection (21) and are delimited by the projection (21).

8. The radial fan (1) according to claim 1, characterized in that at least one air-guiding channel (L) extends through a housing bottom plate (2*a*) of the fan housing (2), plate which is located flat beneath the fan wheel (30).

9. The radial fan (1) according to claim 1, characterized in that the opening to the air-guiding channel (L) in the first pressure chamber region (2*a*) and the opening to the air guide channel (L) in the second pressure chamber region (2*b*) of the spiral pressure chamber (D) are provided in diametrically opposite positions.

10. The radial fan (1) according to claim 1, wherein a projection (21) is formed by the bearing tube (20) and is configured as a round projection, the diameter $D_A$ of which is greater than the diameter $D_V$ of the fan wheel and further characterized in that the projection (21) is located between the housing bottom plate (2*a*) of the fan housing (2) and the fan wheel (30), and the bearing tube (20) with its radial projection (21) rests flat on a housing bottom plate (2*a*) of the fan housing (2).

11. The radial fan (1) according to claim 1, characterized in that the shaft (40) is mounted on a first bearing (24) arranged in the bearing tube (20) and on a second bearing (25) arranged spaced axially therefrom in the bearing tube (20) in a region between the fan wheel (30) and the rotor (50), and the air-guiding channel (L) extends so that an air flow flows around the region of the bearings (24, 25).

12. The radial fan (1) according to claim 1, characterized in that the separating can (3) is configured to form a single piece with the fan housing (2).

* * * * *